United States Patent [19]

Dukic, Jr.

[11] Patent Number: 4,704,142

[45] Date of Patent: Nov. 3, 1987

[54] VACUUM SWEEPER

[76] Inventor: George Dukic, Jr., 933 McIntosh Dr., McKeesport, Pa. 15132

[21] Appl. No.: 898,529

[22] Filed: Aug. 21, 1986

[51] Int. Cl.[4] ..... B01D 19/00

[52] U.S. Cl. ..... 55/250; 15/351; 15/353

[58] Field of Search ..... 55/95, 235, 239, 244, 55/250, 248, 337, 473; 15/350, 351, 353; 261/79 A, 119.1

[56] References Cited

U.S. PATENT DOCUMENTS 997,864 7/1911 Simpson ..... 55/250
1,011,989 12/1911 Mohr ..... 15/350
2,250,226 7/1941 Juelson ..... 55/255
4,372,760 2/1983 Zantwyk ..... 55/244

*Primary Examiner*—Bernard Nozick
*Attorney, Agent, or Firm*—William J. Ruano

[57] ABSTRACT

A vacuum cleaner wherein the dirty air discharge outlet is connected by a hose through a lid inlet of a container which is partially filled with water and the hose end is suspended from said inlet to about ¼" from the top of the water surface. The lower end of the suspended portion of said hose is projected at an angle onto the water surface to swirl it and effectively trap dust particles in the water. The remaining dust containing air passes through a secondary filter in the lid of the container before being discharged to the surrounding atmosphere.

1 Claim, 9 Drawing Figures

VACUUM SWEEPER

This invention relates to a vacuum sweeper such as used in households and, more particularly, to a filtering system therefor.

BACKGROUND OF THE INVENTION

Presently used household vacuum sweepers have the outstanding disadvantage of emitting dust as a result of their present construction. This is a great annoyance to residents who have to breathe the dust. Moreover, dust particles accumulate on various objects of furniture, drapes, etc. requiring frequent cleaning.

An object of the present invention is to provide a novel sweeper filter construction which completely eliminates the above-named disadvantages, thereby providing clean air even after excessive sweeping.

A more specific object of the invention is to provide a novel filtering construction for an electric vacuum sweeper which completely eliminates the discharge of dust-laden air.

SUMMARY OF THE INVENTION

The vacuum cleaner of the present invention embodies a tank holding water. A rubber adapter is attached to the sweeper outlet and conducts dirty air intake through the lid of the tank which is partially filled with water. Suspended from the air intake is a conduit or hose which discharges dirty intake air just immediately above the level of the water at such angle as to effect a swirling of the water so as to trap dust particles from the intake air and act as a primary filter. Any remaining dust is trapped in a secondary air filter contained in the lid of the tank so as to completely clean the air which is discharged into the atmosphere from an exhaust outlet in the lid.

DETAILED DESCRIPTION OF THE PREFERRED EMBODIMENT

Figure 1:
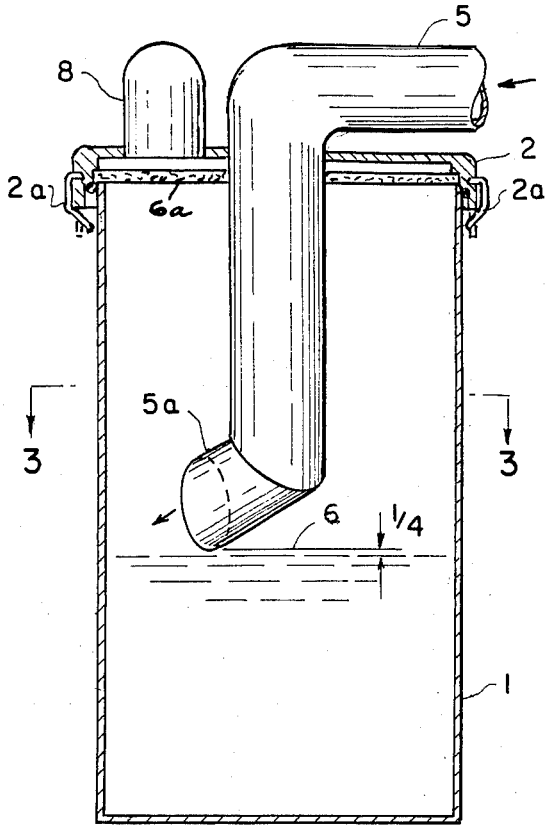
FIG. 1 is a vertical cross-sectional view of a vacuum sweeper filtering system embodied in the present invention and taken along line 1—1 of FIG. 2
Figure 2:
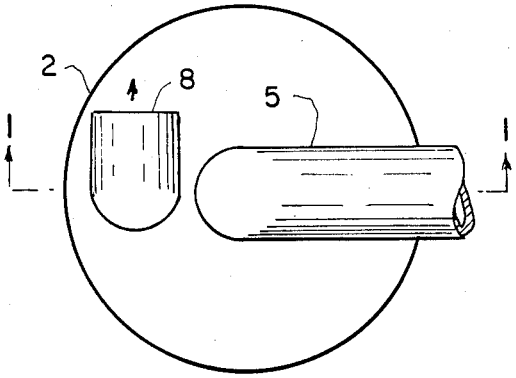
FIG. 2 is a top view of FIG. 1 showing the intake and exhaust of air from the sweeper.

Referring more particularly to FIGS. 1, 2, 3, and 4, numeral 1 denotes a cylindrical tank of any suitable material, such as transparent plastic material of a size of about 5-inch diameter by about 9-inches in length and having a lid 2 clamped to the top thereof by spring clamps 2*a*. Air from a vacuum sweeper 3, including an electric motor driven brush (not shown), of well-known type construction is conducted to the cylinder 1 by attaching to the sweeper outlet a tubular rubber adaptor 4 connected to hose 5 of about $1\frac{1}{4}$ inch diameter which leads into the top of lid 2 thereby serving as an intake connection.

Figure 3:
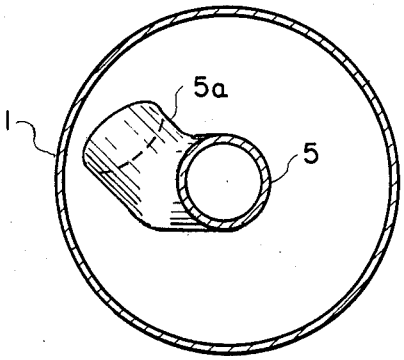
FIG. 3 is a horizontal cross-sectional view taken along line 3—3 of FIG. 1.
Figure 1A:
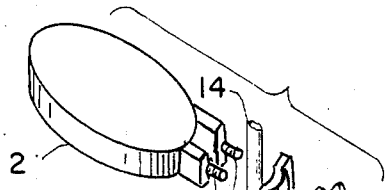
FIG. 1*a* is a perspective exploded view of a modification of the clamp.
Figure 4:
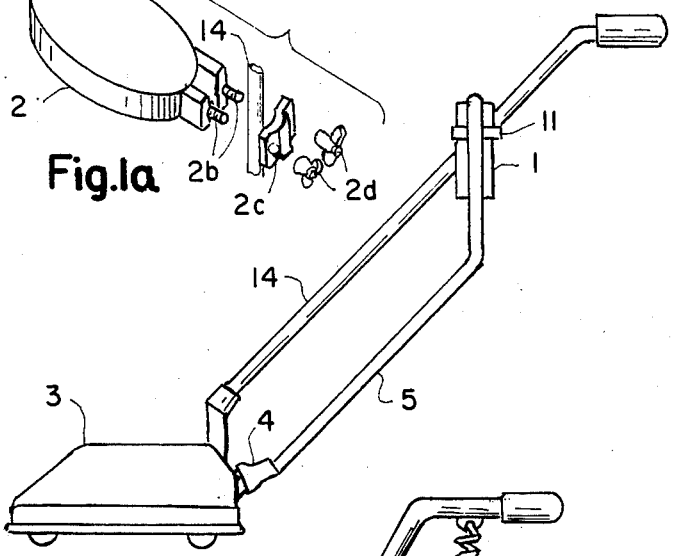
FIG. 4 is an elevational view of the complete vacuum sweeper and filtering assembly of FIG. 1, the latter shown in reduced scale.

An important feature of the invention is the provision of a body of water 6, of about $3\frac{3}{8}$ inches high, in the tank 1 into the top of which is blown the dirty or dusty intake air. I have found, unexpectedly, that the end portion 5*a* of the intake air hose should be angled preferably at an angle of 26°30′ relative to the horizontal top surface of the body of water. Also, it should be angled about 25° in a horizontal direction, as shown in FIG. 3. The bottom of the intake nozzle 5 has an end portion 5*a* which is preferably located about $\frac{1}{4}$ inch above the top surface of the body of water.

In operation, the intake dirty air is discharged from the outlet 5*a* which by being disposed at an angle to the top surface of the body of water as well as angled in a horizontal direction, will cause the water body to swirl vigorously and in so doing, effectively absorbing and trapping the dust particles in the body of water which serves as a primary filter. Thus, most of the dust is discharged into the body of water and any remaining dust will be trapped by filter 6a so that absolutely clean air will be discharged from the exhaust outlet 8 into the room. Thus the room is kept dust-free even after long use of the sweeper so as to avoid inhaling of any exhaust dust by the housewife or residents and in so doing, avoiding the deposit of dust on furniture, drapes, or the like.

Lid 2 may be clamped to handle 14 by clamp 2*a* held by screws 2*b* and wing nuts 2*d*.

Tank 1 may be provided with a flexible plastic throw-away bag inside thereof. Moreover, tank 1 itself may be in the form of a flexible throw-away bag in the shape of well-known throwaway dust collecting bags of sweepers.

Figure 5:
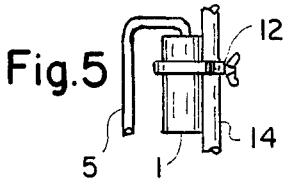
FIG. 5 is a fragmentary view showing a modified type of mounting for the tank shown in FIG. 1.

FIG. 5 shows one means of supporting the tank on the sweeper end by means of a "U"-shaped clamp 11 having ends which are attached to a bracket 12 of "U" shape by wing nuts 13 for holding the tank firmly on the sweeper handle 14.

Figure 6:
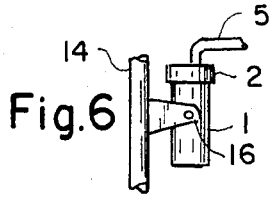
FIG. 6 is a fragmentary view of another modified form of mounting for the tank shown in FIG. 1.

FIG. 6 shows a modification wherein a bracket 15 is integrally secured to the handle 14 and is pivotally connected by means of pivot 16 to the tank 1 so that the tank will remain upright while the sweeper handle is tilted.

Figure 7:
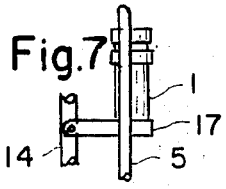
FIG. 7 is a fragmentary view of a still further modification of the mounting of the tank shown in FIG. 1; and, FIG. 8 is a even further modification of the mounting of the tank on the sweeper.

FIG. 7 shows a further modification wherein the tank 1 is held by a base 17 which is rigidly secured to handle 14.

Figure 8:
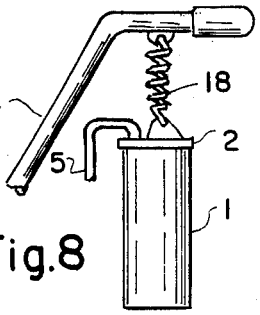

FIG. 8 shows a still further modification wherein the tank 1 is suspended by a strong spring 18 having an end connected to the handle 14.

Other means for supporting the container for the water may be devised to keep the water level substantially constant while sweeping, either using the container itself, or a container lined with a filter.

Thus it will be seen that I have provided a highly efficient vacuum sweeper, and particularly, its filtering system, involving trapping the dust particles in water, thence through a filter, after which it is discharged completely dust-free into the atmosphere.

While I have illustrated and described several embodiments of my invention, it will be understood that these are by way of illustration only and that various changes and modifications may be contemplated in my invention and within the scope of the following claim.

I claim:

1. In combination with a vacuum sweeper having a dirty air outlet hose, a container having a lid and being partially filled with water and through which lid said dirty air outlet hose is led and suspended to close proximity to the top level of said water at an angle to the water surface so as to swirl the water and cause it to trap dust particles, and a clean air outlet extending from the top of said lid, a secondary filter immediately below said lid for further filtering said dirty air before it emerges from said clean air outlet, said angle being about 26 degress, and the lower end of said suspended hose being about $\frac{1}{8}$ inch above the water surface, the lower end of said suspended hose bending about 25 degrees in a substantially horizontal direction at its lower dirty air discharging end, a sweeper handle, and pivotal means for pivotally holding said tank in a vertical position on said handle irrespective of tilting movements of said handle.

* * * * *